United States Patent [19]

Russell

[11] Patent Number: 5,056,790

[45] Date of Patent: Oct. 15, 1991

[54] GOLF PRACTICE DEVICE

[76] Inventor: Neil W. Russell, Aberdare Hotel, Weston, NSW 2326, Australia

[21] Appl. No.: 613,885

[22] PCT Filed: May 22, 1989

[86] PCT No.: PCT/AU89/00228

§ 371 Date: Dec. 24, 1989

§ 102(e) Date: Dec. 24, 1989

[87] PCT Pub. No.: WO89/11315

PCT Pub. Date: Nov. 30, 1989

[30] Foreign Application Priority Data

May 20, 1988 [AU] Australia ..... PI8362

[51] Int. Cl.[5] ..... A63B 69/36

[52] U.S. Cl. ..... 273/184 B; 273/198

[58] Field of Search ..... 273/184 B, 185 C, 185 D, 273/198, 197 R, 197 A, 196, 183 C, 184 R, 185 R, 185 A, 185 B

[56] References Cited

U.S. PATENT DOCUMENTS

| | | | |
|---|---|---|---|
| 1,528,739 | 3/1925 | Boyce | 273/198 |
| 1,730,176 | 10/1929 | Thrasher et al. | 273/200 R |
| 1,967,776 | 7/1934 | Merritt | 273/200 R |
| 2,051,751 | 8/1936 | Simon | 273/185 C |
| 3,124,958 | 3/1964 | McDonnell | 273/184 B |

*Primary Examiner*—George J. Marlo

*Attorney, Agent, or Firm*—Helfgott & Karas

[57] ABSTRACT

A golf practice device in which a practice ball (16) is connected by a flexible cord (18) to a ball-control frame (11) mounted rotatably on a base (10), characterized in that: when the device is arranged operatively, the base is secured at a location at which a golf club may be swing to strike said ball, the flexible cord being substantially inelastic and acting, when the ball is struck, to effect rotation of the ball-control frame, the latter having damping means (27) arranged to allow the cord to extend to an extent commensurate with the striking force on the ball.

10 Claims, 2 Drawing Sheets

GOLF PRACTICE DEVICE

TECHNICAL FIELD

This invention relates to golf practice devices and more particularly to devices which may be used to enable a golfer to practice the driving of golf balls with clubs of any loft or material, regardless of restrictions imposed by weather or limited space.

BACKGROUND ART

Frequently a keen golfer finds himself without access to a golf course, and in that event a driving range can be quite satisfactory because full swinging and ball-travel facilities are achievable. Thus, golf driving ranges have become popular to allow a person to practice in company with other golfers who take up positions in a row of driving positions and then drive balls in directions normal to that row. Such a golf range has the disadvantage that it requires a large land area and is most popular if located in a city region where the cost of land for such purposes is prohibitive. Also, the use of a driving range can be curtailed if the weather is bad, while additionally the retrieval of struck balls can be tedious and time-consuming.

Some golfers find preferable the use of net systems in which a golfer can drive balls from a mat or the like into a semi-enclosure, the balls striking a back net which catches the balls or causes them to drop to the ground, while side and top nets prevent the golf balls from straying from the local vicinity. Such net systems do not require large areas of expensive land and make ball retrieval easy, but most golfers do not find them very satisfactory because it is difficult to envisage or estimate the distance which the struck ball might have travelled.

Various portable devices have been proposed generally to assist golfers to practice the driving of golf balls, but most are inefficient or cause early loss of interest. For example, a practice kit is known in which a practice ball is connected by a flexible cord to a frame which may be secured to the ground by pegs or "anchored" on a floor by a suitable weight, a spring or elasticised cord portion being incorporated to limit travel of the struck ball and to cause it to return. However, such kits have become currently unpopular because of the considerable number of accidents involving balls returning to strike the person practising driving.

DISCLOSURE OF INVENTION

Thus there is a need for a device which a golfer may use in a confined space, such as the back yard of a home, or within a garage for example if the weather is inclement, which device is relatively inexpensive, does not require more than a minimum area of land and does not require a netting system. Accordingly, the invention has for its principal object the provision of a golf practice device which ameliorates or overcomes the disadvantages as aforementioned in relation to known practice arrangements or devices.

With the foregoing and other objects in view, the invention resides broadly in a golf practice device in which a practice ball is connected by a flexible cord to a ball-control frame mounted rotatably on a base, characterised in that:

when the device is arranged operatively, the base is secured at a location at which a golf club may be swung to strike said ball, the flexible cord being substantially inelastic and acting, when the ball is struck, to effect rotation of the ball-control frame, the latter having damping means arranged to allow the cord to extend to an extent commensurate with the striking force on the ball.

More specifically, in a broad preferred form the invention provides a golf practice device in which a practice ball is connected by a flexible cord to a ball-control frame mounted on a base, characterised in that:

when the device is arranged operatively, the base is secured at a location at which a golf club may be swung to trace out a club-head path, the ball-control frame then extending upwardly from the base and being rotatable about a vertical axis;

the flexible cord is substantially inelastic and has one end connected to the ball, while its other end is operatively associated with a damping device mounted reciprocally on the ball-control frame;

the ball may be placed manually at an initital striking station adjacent to but spaced from said base and ball-control frame, said cord having a first cord portion arranged to extend tautly from the ball to the ball-control frame at right angles to the club-head path;

striking of the ball causes rotation of the ball-control frame in unison with rotation of said first cord portion, while additionally the force imparted to the ball tending to move it tangentially to its substantially circular path acts to withdraw the cord lengthwise of itself and from the ball-control frame to actuate said reciprocally mounted damping device in its first-direction damping action, the more effective the striking force the greater the lengthwise withdrawal of the cord;

the reciprocally mounted damping device has a second-direction return action effective to return the cord to its initial lengthwise disposition as the ball-control frame ceases rotation, whereupon the ball may be again set manually at the striking station.

So that different distances can be read from the device commensurate with the striking force, there may be provided visual indicator means to show the extent of lengthwise withdrawal of the cord on each striking action. For that purpose, the cord may suitably be arranged to pass over a plurality of pulleys on the ball-control frame, the cord having an intermediate portion extending beside a calibrated scale on the ball-control frame, the visual indicator means comprising a pointer on the intermediate cord portion to co-operate with the calibrated scale.

In a preferred embodiment, the ball-control frame has a mounting cylinder in which a piston-like member is axially slidable to act as the damping device, reciprocal motion thereof taking place on the vertical axis of rotation of the ball-control frame. In that instance, the mounting cylinder suitably constitutes a liquid chamber for the piston-like member, the latter being of a weight causing it to be disposed lowermost when the ball is at the striking station, the cord acting through pulleys to raise the piston-like member and displace liquid when the ball is struck, thereby providing a damping action in accordance with the force exerted on the cord when the ball is struck.

Other features and preferred details of the invention will be hereinafter described, such as the provision of an inelastic safety line to prevent the ball flying dangerously from the device if the cord should snap, as well as mounting arrangements for the base such as the incorporation of a practice mat and the provision of a tee to constitute the striking station.

BEST MODE FOR CARRYING OUT THE INVENTION

Figure 1:
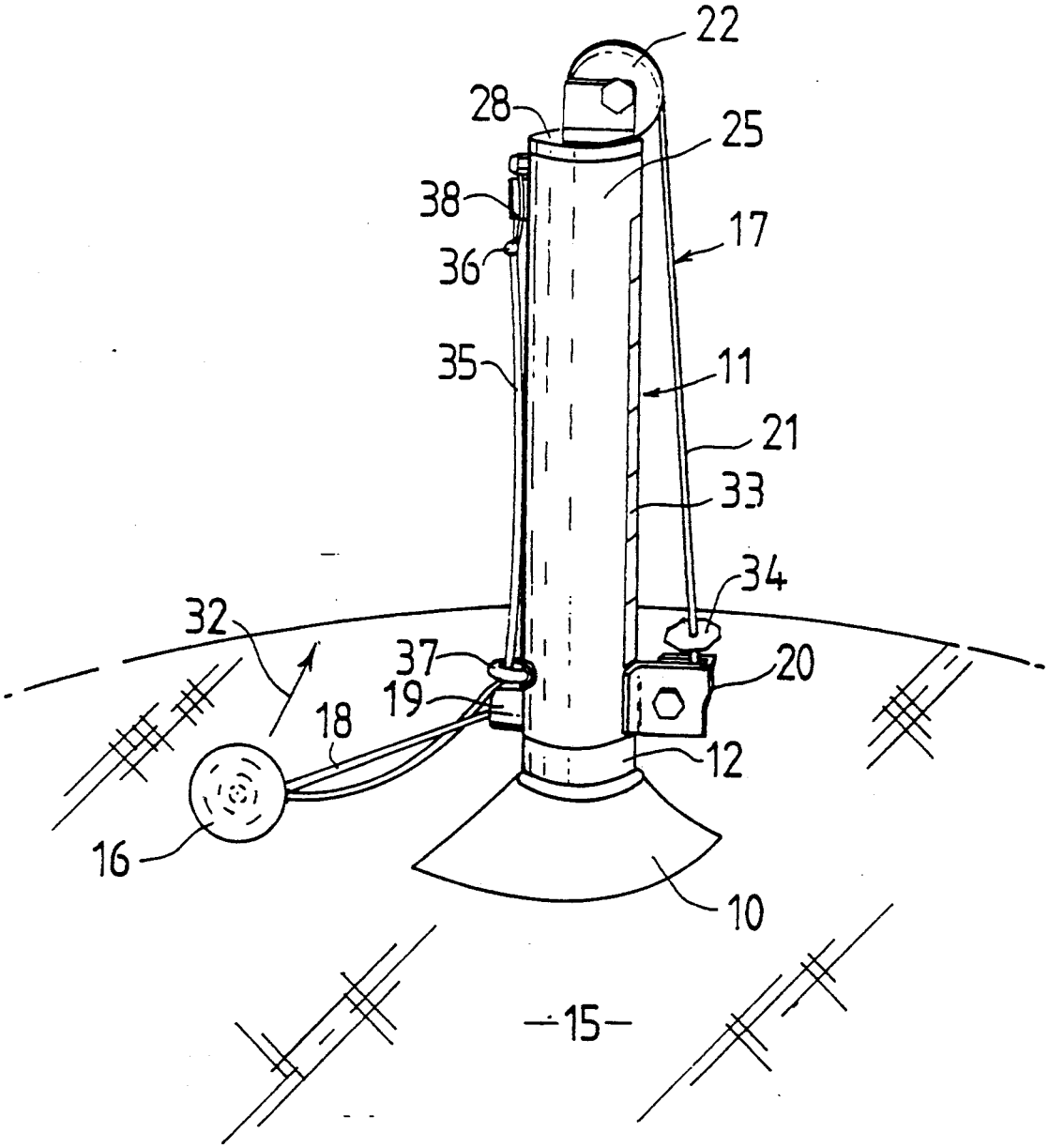
FIG. 1 shows a perspective view a preferred form of golf practice device in accordance with one embodiment of the invention.

The illustrated golf practice device comprises a base 10 having mounted thereon a ball-control frame 11 with an interposed ball-race 12 permitting rotation of the frame 11 about a vertical axis 13. The base 10 is suitably made of wood and has a central tapped aperture 14 to receive a stud (not shown) which serves to connect the parts together and to mount the device on a strengthening plate secured to a mat 15 of rubber, carpet or the like on which the ball 16 may rest. It will be apparent that when the device is arranged operatively, the base 10 and attached mat 15 are secured at a location at which a golf club may be swung to trace out a club-head path, the frame 11 extending upwardly from the base 10 and being rotatable about the vertical axis 13.

The call 16 is connected to one end of an inelastic cord 17 which extends through a first cord portion 18 to the frame 11 where it passes through a diametral guide sleeve 19 and then under and around a lower pulley 20. The cord 17 then has an upwardly extending run or intermediate portion 21 leading up to and around a top pulley 22 from which the final run 23 of the cord 17 passes down the axis 13 to its lower extremity where it is formed into a knot 24 for the purposes described below.

Figure 2:
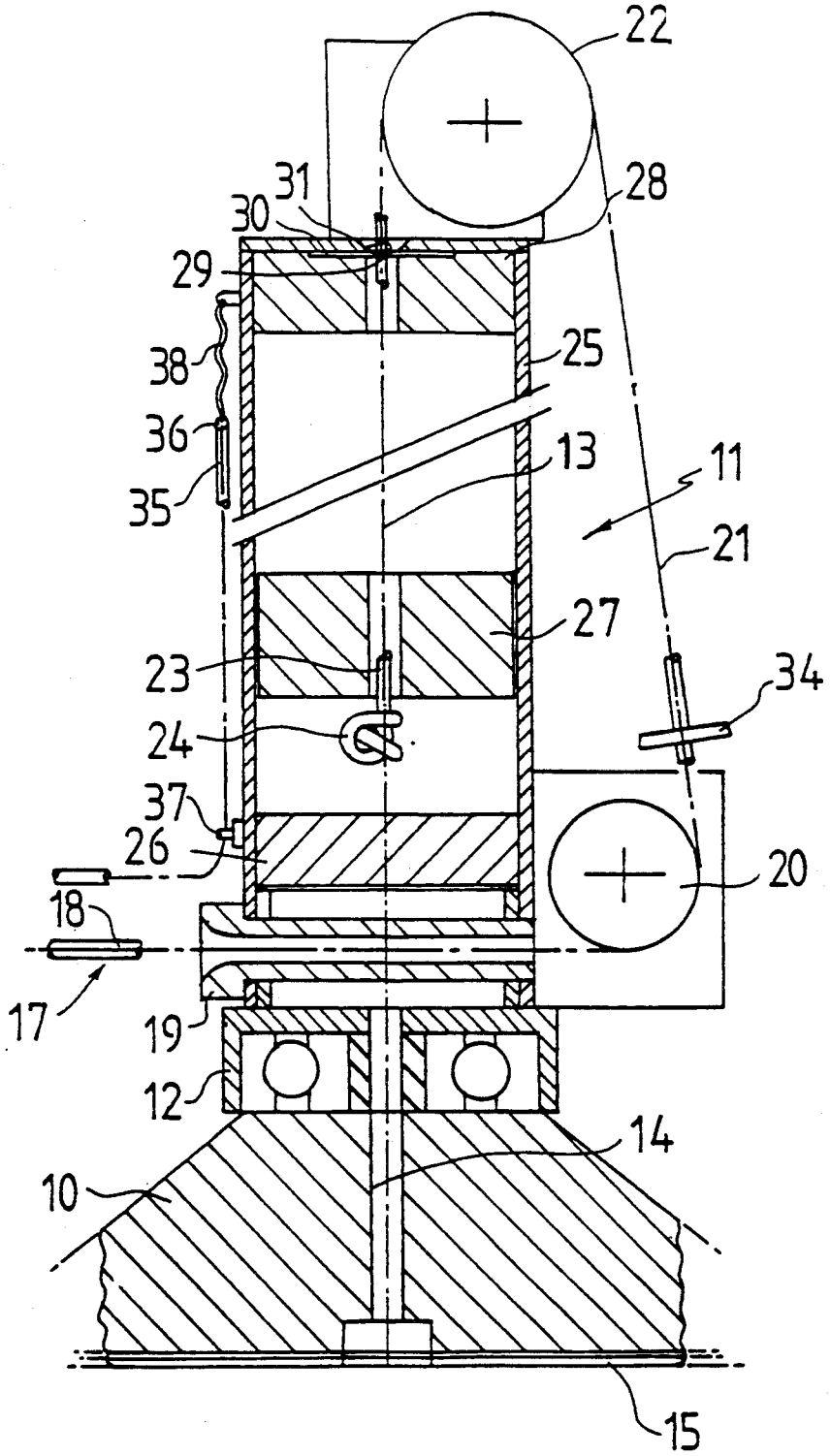
FIG. 2 is a cross-sectional elevational view showing the principal components of the device of FIG. 1.

The ball-control frame 11 consists essentially of a metal cylinder 25 which is closed by a bottom plug 26 just above the cord guide sleeve 19. The cylinder 25 contains water in operation and has a piston-like member 27 arranged slidably therein, this being a heavy weight or a plurality of weights interconnected and able to be raised from the lower position to that shown in FIG. 2 by virtue of the knot 24 when the cord 17 is withdrawn from the frame 11. The member 27 thus acts as a damping device mounted reciprocally on the frame. So that water may be displaced from either end of the cylinder 25 to the other, the piston 27 has apertures of desired size therethrough from top to bottom, this preferably being achieved by making the piston a loose fit in the cylinder whereby water passes peripherally of the piston 27. The upper end of the cylinder 25 is closed by a screw 28 having an axial aperture 29 through which the cord extends, the lower face of the plug 28 having a sealing washer 30 provided with a small axial aperture 31 in which the cord 17 is a close fit to prevent upward leakage from the top of the frame 11, the top screw plug 28 acting as a mounting for the bracket supporting the upper pulley 22.

So far as the action of the cord 17 is concerned, it will be appreciated that the ball 16 may be placed manually at an initial striking station about 150 mm from the cylinder 25 (which is about 50 mm in diameter in the illustrated embodiment) so that the first cord portion 18 extends tautly from the ball 16 to the guide sleeve 19 of the frame 11 in a direction at right angles to the club-head path. When the ball 16 is struck, the ball moves tangentially to a circle about the axis 13 and forces the frame 11 to rotate about that axis in unison with the first cord portion 18 which maintains the inter-relationship. Additionally, the force imparted to the ball 16, tending to move it tangentially to said circle, acts to withdraw the cord 17 lengthwise of itself and through the guide sleeve 19 from the frame 11 so that the cord actuates the damping device by lifting the piston 27 along vertical axis 13, the more effective the striking force the greater the lengthwise withdrawal of the cord 17. As the affect of the striking action dissipates and fraction takes over, the piston 27 lowers gravitationally and the cord returns to its initial lengthwise disposition as the frame 11 comes to rest, whereupon the ball 16 may be again set manually at the striking station. Preferably, a tee of rubber or other material is secured on the mat 15 to constitute the aforementioned striking station.

A feature of the preferred embodiment is the provision of visual indicator means to show the extent of lengthwise withdrawal of the cord 17 on each striking of the ball 16. It will be seen that the ball-control frame 11 between the pulleys 20 and 22 has a calibrated scale 33 on the outside of the cylinder 25 and extending in the axial direction which is also the direction of the intermediate cord portion 21. There is provided a pointer member 34 having an aperture through which the cord extends closely in frication-gripping manner. At the end of each operation, the pointer member 34 is moved back down manually to the bottom of the scale 33 adjacent the pulley 20. When the ball is struck to extend the cord, the latter slides through the aperture in the pointer member 34 without the latter being able to move further down. The return action of the damper device allows the cord run 21 to move upwards and the pointer member 34 is then registering with appropriate markings on the scale 33, showing a reading commensurate with the force with which the ball was struck.

The device is also fitted with a safety line 35 having one end connected to the ball 16 at its connection to the cord 17, the line 35 being of a length greater than the normal maximum length of withdrawal of the cord 17 but arranged so as to limit the distance the ball may fly from the device in the event of the cord snapping. For this purpose, the end of the end of the line 35 remote from the ball had a knot 36 unable to pass through an eyelet 37 on the cylinder 25, there being a light elastic band 38 arranged to maintain the line 35 within the frame 11 when not required for safety emergency.

The manner of using the device has been described above progressively in the enumeration of the components and features, and it will be apparent that the illustrated embodiment will be found very effective in achieving the objects for which the invention has been devised. Naturally the components may be made of desired materials, and various design features may be the subject of considerable modification without departing from the broad scope and ambit as will be apparent to the skilled reader. For example, the ball may, in my illustrated embodiment, cause the frame to rotate three or four times before coming to rest, but this would vary according to minor design changes in a number of components. The scale may be calibrated in yards or meters and a golfer can compete against others or play all clubs successively against set markings.

I claim:

1. A golf practice device in which a practice ball is connected by a flexible cord to a ball-control frame mounted on a base, characterised in that:

when the device is arranged operatively, the base is secured at a location at which a golf club may be swung to trace out a club-head path, the ball-control frame then extending upwardly from the base and being rotatable about a vertical axis;

the flexible cord is substantially inelastic and has one end connected to the ball, while its other end is operatively associated with a damping device mounted reciprocally on the ball-control frame;

the ball may be placed manually at an initial striking station adajcent to but spaced from said base and ball-control frame, said cord having a first cord portion arranged to extend tautly from the ball to the ball-control frame at right angles to the club-head path;

striking of the ball causes rotation of the ball-control frame in unison with rotation of said first cord portion, while additionally the force imparted to the ball tending to move it tangentially to its substantially circular path acts to withdraw the cord lengthwise of itself and from the ball-controlled frame to actuate said reciprocally mounted damping device in its first-direction damping action, the more effective the striking force the greater the lengthwise withdrawal of the cord;

the reciprocally mounted damping device has a second-direction return action effective to return the cord to its initial lengthwise disposition as the ball-control frame ceases rotation, whereupon the ball may be again set manually at the striking station.

2. A golf practice device according to claim 1 and further characterized in that visual indicator means are provided to show the extent of lengthwise withdrawal of the cord on each striking of the ball.

3. A golf practice device according to claim 2 and further characterised in that the cord is arranged to pass over a plurality of pulleys on the ball-control frame and includes an intermediate cord portion extending beside a calibrated scale on the ball-control frame, said visual indicator means comprising a pointer on the intermediate cord portion to co-operate with said calibrated scale.

4. A golf practice device according to claim 1 and further characterised in that the ball-control frame includes a mounting cylinder for a piston-like member arranged to act as said damping device, said piston-like member being movable reciprocally on the vertical axis of rotation of said ball-control frame.

5. A golf practice device according to claim 4 and further characterised in that said mounting cylinder constitutes a liquid chamber within which the reciprocal piston-like member, being of heavy construction, normally occupies a lower position gravitationally when the ball is at the striking station, the cord acting through pulleys to raise the piston-like member when the ball is struck and so displace liquid downwardly via clearance spaced in or around said piston-like member, the extent of the resultant damping action varying according to the force exerted on the cord when the ball is struck.

6. A golf practice device according to claim 5 and further characterised in that said other end of said cord is secured to the lower face of the piston-like member, said cord passing up through a central aperture of the piston-like member on the axis of rotation and through central apertures in a top cap and sealing washer at the upper end of the liquid chamber.

7. A golf practice device according to claim 1 and further characterised in that an inelastic safety line is secured to said ball adjacent the connection thereto of the cord, said line being of a length greater than the normal maximum length of withdrawal of the cord and arranged so as to limit the distance the ball may travel away from the ball-control frame in the event of the cord breaking, elasticised take-up means being provided to maintain the line within the ball-control frame when it is inoperative.

8. A golf practice device according to claim 1 and further characterised in that the base is a block of wood or other solid material secured to a mounting plate which is in turn secured to a mat of rubber, carpet or the like on which the ball may come to rest.

9. A golf practice device according to claim 8 and further characterised in that a tee of rubber or other material is secured on said mat to constitute the said striking station.

10. A golf practice device in which a practice ball is connected by a flexible cord to a ball-control frame mounted rotatably on a base, characterised in that:

when the device is arranged operatively, the base is secured at a location at which a golf club may be swung to strike said ball, the flexible cord being substantially inelastic and acting, when the ball is struck, to effect rotation of the ball-control frame in a circular path, the latter having damping means arranged to allow the cord to extend to an extent commensurate with the striking force on the ball.

* * * * *